US009002222B2

(12) United States Patent
Tanaka

(10) Patent No.: US 9,002,222 B2
(45) Date of Patent: Apr. 7, 2015

(54) IMAGE FORMING APPARATUS AND NON-TRANSITORY COMPUTER READABLE MEDIUM

(75) Inventor: Satoshi Tanaka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 448 days.

(21) Appl. No.: 13/549,096

(22) Filed: Jul. 13, 2012

(65) Prior Publication Data

US 2013/0251388 A1 Sep. 26, 2013

(30) Foreign Application Priority Data

Mar. 21, 2012 (JP) ..... 2012-064558

(51) Int. Cl.
*G03G 15/00* (2006.01)
*G03G 15/01* (2006.01)

(52) U.S. Cl.
CPC ..... *G03G 15/0189* (2013.01); *G03G 15/5058* (2013.01)

(58) Field of Classification Search
USPC ..... 399/49, 72
See application file for complete search history.

(56) References Cited

U.S. PATENT DOCUMENTS

2007/0297817 A1* 12/2007 Bessho ..... 399/27
2010/0247125 A1* 9/2010 Akita ..... 399/49

FOREIGN PATENT DOCUMENTS

JP 2001-066842 A 3/2001
JP 3804355 B2 8/2006

* cited by examiner

*Primary Examiner* — Billy Lactaoen
(74) *Attorney, Agent, or Firm* — Sughrue Mion, PLLC

(57) ABSTRACT

An image forming apparatus includes a preliminary toner image forming unit, a detecting unit, an adjusting unit, an obtaining unit, an activation grasping unit, a determining unit, and a preparation unit. The preliminary toner image forming unit causes an inactive image forming unit to form a preliminary toner image and causes the preliminary toner image to be transferred onto a transfer body. The detecting unit detects the preliminary toner image. The adjusting unit adjusts quality of a toner image. The obtaining unit obtains information regarding an image to be output. The activation grasping unit grasps an estimated activation timing. The determining unit determines whether a time period until the estimated activation timing has become equal to an image quality adjustment period. The preparation unit causes the preliminary toner image forming unit to transfer the preliminary toner image and causes the adjusting unit to adjust the quality of the toner image.

6 Claims, 8 Drawing Sheets

IMAGE FORMING APPARATUS AND NON-TRANSITORY COMPUTER READABLE MEDIUM

CROSS-REFERENCE TO RELATED APPLICATIONS

This application is based on and claims priority under 35 USC 119 from Japanese Patent Application No. 2012-064558 filed Mar. 21, 2012.

BACKGROUND

(i) Technical Field

The present invention relates to an image forming apparatus and a non-transitory computer readable medium.

SUMMARY

According to an aspect of the invention, there is provided an image forming apparatus including a preliminary toner image forming unit, a detecting unit, an adjusting unit, an obtaining unit, an activation grasping unit, a determining unit, and a preparation unit. The preliminary toner image forming unit causes an inactive image forming unit, among plural image forming units that are used to form toner images, to form a preliminary toner image for adjusting image quality and causes the preliminary toner image to be transferred onto a transfer body, which is rotating, before the inactive image forming unit is activated to form a toner image. The detecting unit detects the preliminary toner image which has been moved along with rotation of the transfer body. The adjusting unit adjusts quality of a toner image to be formed by the inactive image forming unit in accordance with a result of detection performed by the detecting unit. The obtaining unit obtains information regarding an image to be output from a body of the image forming apparatus. The activation grasping unit grasps, from the information obtained by the obtaining unit, an estimated activation timing at which the inactive image forming unit among the plural image forming units is to be activated. The determining unit determines whether or not a time period until the estimated activation timing grasped by the activation grasping unit has become equal to an image quality adjustment period that is necessary for adjusting, by using the preliminary toner image forming unit, the detecting unit, and the adjusting unit, the quality of the toner image to be formed by the inactive image forming unit. If the determining unit determines that the time period until the estimated activation timing has become equal to the image quality adjustment period, the preparation unit causes the preliminary toner image forming unit to transfer the preliminary toner image onto the transfer body and causes the adjusting unit to adjust the quality of the toner image to be formed by the inactive image forming unit in accordance with the result of detection performed by the detecting unit, while a toner image is being formed by an active image forming unit among the plural image forming units before the estimated activation timing grasped by the activation grasping unit arrives.

BRIEF DESCRIPTION OF THE DRAWINGS

An exemplary embodiment of the present invention will be described in detail based on the following figures, wherein.

DETAILED DESCRIPTION

An image forming apparatus and a productivity enhancement program according to an exemplary embodiment of the present invention will be described with reference to FIGS. 1 to 8. The direction indicated by arrow H in FIG. 8 is regarded as a height direction of the apparatus, and the direction indicated by arrow W in FIG. 8 is regarded as a width direction of the apparatus.

Configuration of Entire Image Forming Apparatus

Figure 8:
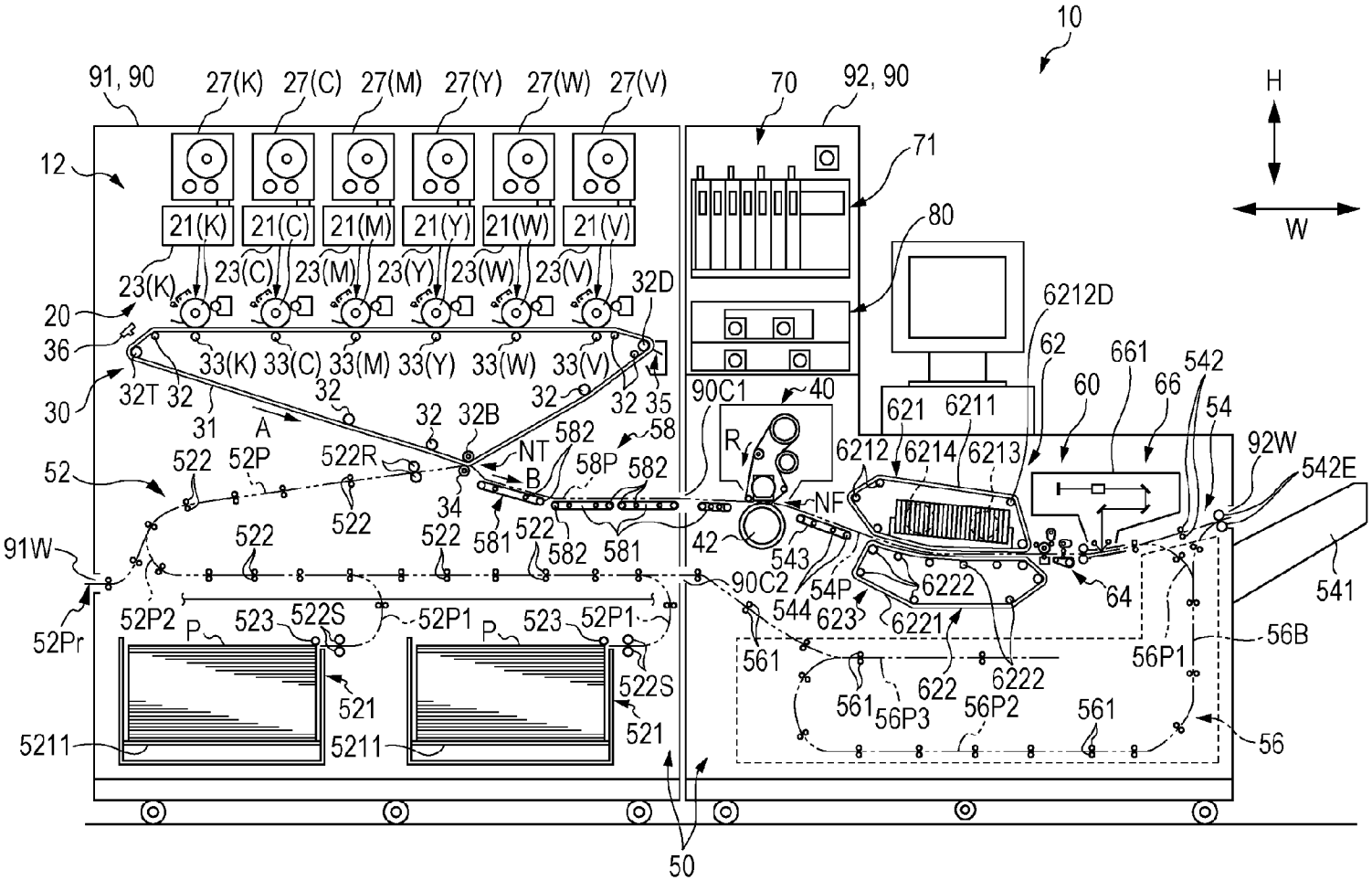
FIG. 8 is a schematic diagram illustrating the configuration of the image forming apparatus according the exemplary embodiment of the present invention.

FIG. 8 is a schematic diagram illustrating a configuration of an entire image forming apparatus 10 according to the exemplary embodiment viewed from a front side. As illustrated in FIG. 8, the image forming apparatus 10 includes an image forming section 12 that forms an image on a recording medium P using an electrophotographic system, a medium transport device 50 that transports the recording medium P, and a post processing section 60 that performs post processing on the recording medium P on which an image has been formed.

Furthermore, the image forming apparatus 10 includes a controller 70 that controls each of the above-described elements and a power supply unit 80 described below, and also includes the power supply unit 80 that supplies power to each of the above-described elements including the controller 70.

As will be described below, the image forming section 12 includes a toner image forming section 20 that forms toner images, a transfer device 30 that transfers images formed by the toner image forming section 20 onto the recording medium P, and a fixing device 40 that fixes toner images transferred onto the recording medium P to the recording medium P.

The medium transport device 50 includes a medium supplying section 52 that supplies the recording medium P to the image forming section 12, and a medium output section 54 that outputs the recording medium P on which an image has been formed. Also, the medium transport device 50 includes a medium returning section 56 that is used to form an image on both sides of the recording medium P and an intermediate transport section 58 described below.

The post processing section 60 includes a medium cooling section 62 that cools the recording medium P on which an image has been formed by the image forming section 12, a correcting device 64 that corrects a curl of the recording medium P, and an image examining section 66 that examines an image formed on the recording medium P. The elements constituting the post processing section 60 are disposed in the medium output section 54 of the medium transport device 50.

The elements of the image forming apparatus 10 are accommodated in a housing 90, except for an output medium receiver 541, which is included in the medium output section 54 of the medium transport device 50. The housing 90 according to the exemplary embodiment has a two-part configuration including a first housing 91 and a second housing 92, which are adjacent to each other in the width direction of the apparatus. Accordingly, the unit of transport in the image forming apparatus 10 is compact in the width direction.

A principal part of the image forming section 12 except the fixing device 40 described below, and the medium supplying section 52 are accommodated in the first housing 91. The fixing device 40 included in the image forming section 12, the medium output section 54 except the output medium receiver 541, the medium cooling section 62, the image examining section 66, the medium returning section 56, the controller 70, and the power supply unit 80 are accommodated in the second housing 92. The first housing 91 and the second housing 92 are connected to each other via, for example, a connecting member such as a bolt or nut (not illustrated). In this connection state, a connection opening 90C1 and a connection path 90C2 are formed between the first housing 91 and the second housing 92. The connection opening 90C1 is used for supplying the recording medium P from a transfer nip NT to a fixing nip NF of the image forming section 12. The connection path 90C2 is used for supplying the recording medium P from the medium returning section 56 to the medium supplying section 52.

Configuration of Image Forming Section

The image forming section 12 includes the toner image forming section 20, the transfer device 30, and the fixing device 40, as described above. The toner image forming section 20 includes plural image forming units so that toner images of respective colors may be formed. In the exemplary embodiment, the toner image forming section 20 includes image forming units 14 for six colors, including a first special color (V), a second special color (W), yellow (Y), magenta (M), cyan (C), and black (K) (see FIG. 7). The symbols (V), (W), (Y), (M), (C), and (K) in FIG. 8 represent the individual colors. The transfer device 30 transfers, at the transfer nip NT, toner images of the six colors onto the recording medium P from a transfer belt 31, which is an example of a transfer body on which a first transfer process of the toner images of the six colors has been performed. The details will be described below.

In the exemplary embodiment, the first special color (V) is a user-specific corporate color which is used more frequently than the other colors, and the second special color (W) is a transparent color which makes an output image glossy.

Toner Image Forming Section

In the toner image forming section 20, the image forming units 14 for the respective colors have basically the same configuration except that the colors of the toners used therein are different from one another. Thus, the image forming units 14 for the respective colors will be described below without distinguishing them from one another. Each image forming unit 14 includes a photoconductor drum 21, which is an example of an image carrier, a charging device 22, an exposure device 23, a developing device 24, which is an example of a developing device, a cleaning device 25, and a static eliminator 26.

Figure 7:
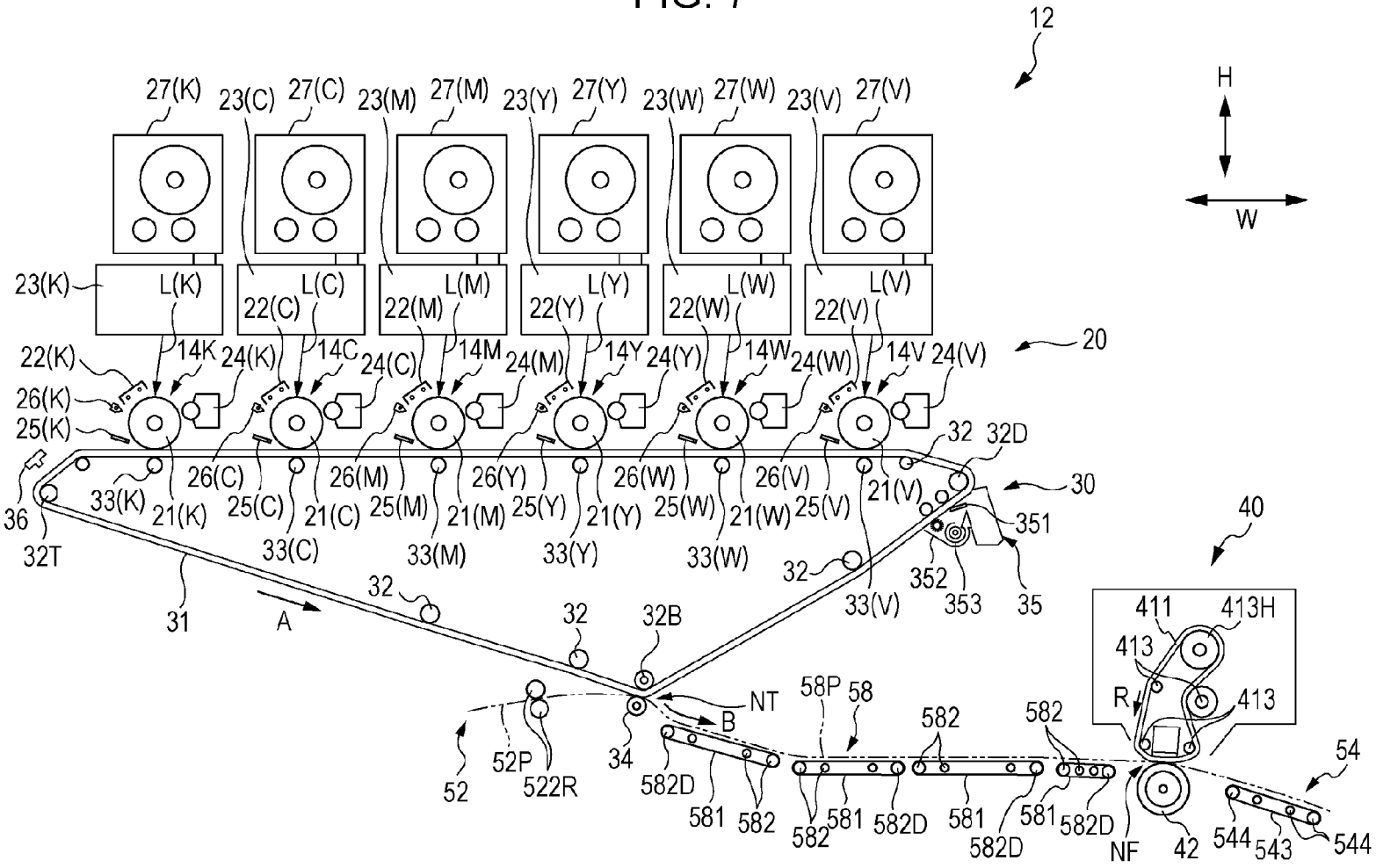
FIG. 7 is a diagram illustrating the configuration of a medium supplying section and an image forming section used in the image forming apparatus according the exemplary embodiment of the present invention.

As illustrated in FIG. 7, the photoconductor drum 21 has a cylindrical shape and is driven by a driving unit (not illustrated) so as to be rotated about the axis thereof. A photosensitive layer having a negative charging polarity is formed on the surface of the photoconductor drum 21. Alternatively, an overcoat layer may be formed on the surface of the photoconductor drum 21. As illustrated in FIG. 8, the photoconductor drums 21 for the respective colors are aligned along the width direction of the apparatus in the front view.

The charging device 22 causes the surface of the photoconductor drum 21 (photosensitive layer) to be negatively charged. In the exemplary embodiment, a scorotron charging device that utilizes a corona discharge scheme (non-contact charging scheme) is used as the charging device 22.

The exposure device 23 forms an electrostatic latent image on the surface of the photoconductor drum 21. Specifically, the exposure device 23 applies modulated exposure light L (see FIG. 6) to the surface of the photoconductor drum 21, which is charged by the charging device 22, in accordance with image data received from an image signal processor 71 included in the controller 70. Due to the irradiation with the exposure light L caused by the exposure device 23, an electrostatic latent image is formed on the surface of the photoconductor drum 21. In the exemplary embodiment, the exposure device 23 causes the surface of the photoconductor drum 21 to be exposed while scanning a light beam emitted from a light source using an optical scanning unit (optical system) including a polygon mirror and an Fθ lens. In the exemplary embodiment, exposure devices 23 for the respective colors are provided.

The developing device 24 develops an electrostatic latent image formed on the surface of the photoconductor drum 21 by using a developer G containing toner, thereby forming a toner image on the surface of the photoconductor drum 21. Though details are omitted, the developing device 24 includes at least a container 241 for storing the developer G, and a developing roller 242 for supplying the developer G in the container 241 to the photoconductor drum 21 while rotating (see FIG. 6). The container 241 is connected to a toner cartridge 27 for supplying the developer G via a supply path (not illustrated). The toner cartridges 27 of the respective colors are aligned along the width direction of the apparatus in the front view in an upper part of the first housing 91, and are individually replaceable.

Figure 6:
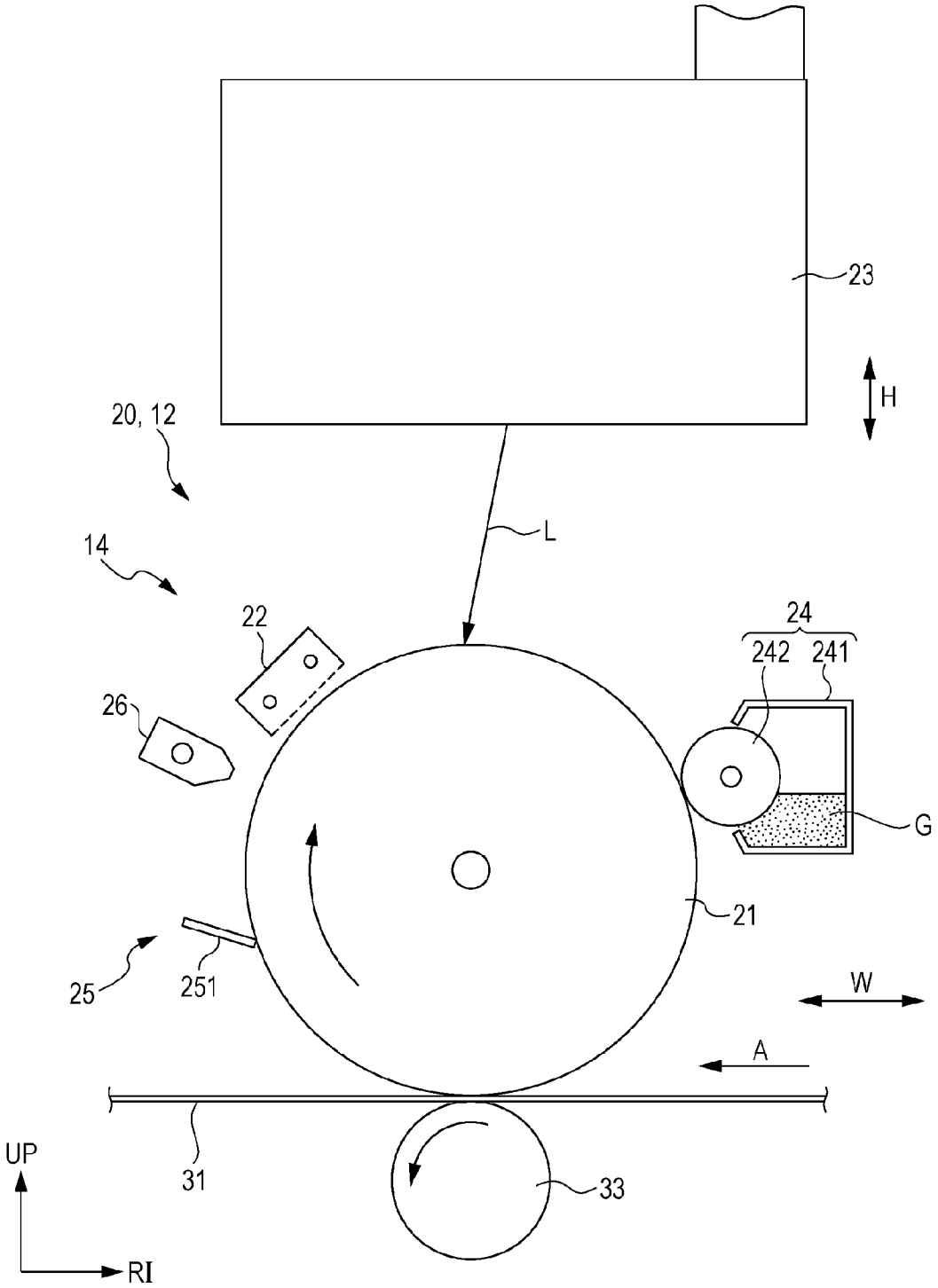
FIG. 6 is a diagram illustrating the configuration of an image forming unit used in the image forming apparatus according the exemplary embodiment of the present invention.

The cleaning device 25 includes a blade 251 for removing residual toner from the surface of the photoconductor drum 21 after a toner image has been transferred to the transfer device 30 (see FIG. 6). Though not illustrated, the cleaning device 25 further includes a housing for storing toner removed by the blade 251, and a transport device for transporting the toner in the housing to a spent-toner box.

The static eliminator 26 applies light to the photoconductor drum 21 after a transfer process, thereby eliminating static electricity. Accordingly, a charge history on the surface of the photoconductor drum 21 is canceled.

Transfer Device

The transfer device 30 performs a first transfer process by superimposing toner images on the photoconductor drums 21 for the respective colors on one another on the transfer belt 31, and performs a second transfer process by transferring the superimposed toner images onto the recording medium P. Hereinafter, the details will be described.

The transfer belt 31 is an endless belt, and the attitude thereof is determined by being wound around plural rollers 32. In the exemplary embodiment, the transfer belt 31 is wound in the form of an inverted obtuse triangle which is long in the width direction of the apparatus in the front view. Among the plural rollers 32, the roller 32D illustrated in FIG. 7 functions as a driving roller for rotating the transfer belt 31 in the direction indicated by arrow A by using the power of a motor (not illustrated).

Among the plural rollers 32, the roller 32T illustrated in FIG. 7 functions as a tension applying roller for applying tension to the transfer belt 31. Among the plural rollers 32, the roller 32B illustrated in FIG. 7 functions as a roller that faces a second transfer roller 34, which will be described below. At the roller 32B, the transfer belt 31 has a lower vertex of the inverted obtuse triangle. The transfer belt 31 is in contact with the lower portions of the photoconductor drums 21 for the respective colors, at the upper side that extends in the width direction of the apparatus in the above-described attitude.

First transfer rollers 33 are disposed on the inner side of the transfer belt 31. The first transfer rollers 33 serve as an example of transfer members that transfer toner images formed on the individual photoconductor drums 21 onto the transfer belt 31. Each of the first transfer rollers 33 is disposed on the opposite side with respect to the photoconductor drum 21 for the corresponding color, with the transfer belt 31 disposed therebetween, or is disposed at a position slightly offset in the rotation direction of the transfer belt 31 with respect to the photoconductor drum 21. Also, a transfer bias voltage having a polarity opposite to a toner polarity is applied by a feed device (not illustrated) to the first transfer rollers 33. The application of such a transfer bias voltage causes a toner image formed on each photoconductor drum 21 to be transferred onto the transfer belt 31.

The transfer device 30 also includes the second transfer roller 34 that transfers toner images superimposed on the transfer belt 31 onto the recording medium P. The second transfer roller 34 is disposed such that the transfer belt 31 is interposed between the second transfer roller 34 and the roller 32B, and forms the transfer nip NT between the second transfer roller 34 and the transfer belt 31. The recording medium P is supplied to the transfer nit NT from the medium supplying section 52 at an appropriate timing. A transfer bias voltage having a polarity opposite to a toner polarity is applied by a feed unit (not illustrated) to the second transfer roller 34. The application of such a transfer bias voltage causes a toner image to be transferred from the transfer belt 31 onto the recording medium P that passes the transfer nip NT.

Furthermore, the transfer device 30 includes a cleaning device 35 that cleans the transfer belt 31 after a second transfer process. The cleaning device 35 is disposed on the downstream side of the portion where a second transfer process is performed (transfer nip NT) and on the upstream side of the portion where a first transfer process is performed in the rotation direction of the transfer belt 31. The cleaning device 35 includes a blade 351 that removes residual toner from the surface of the transfer belt 31. The cleaning device 35 further includes a housing 352 for storing toner removed by the blade 351, and a transport device 353 for transporting the toner in the housing 352 to a spent-toner box (not illustrated).

Fixing Device

The fixing device 40 fixes a toner image onto the recording medium P onto which the toner image has been transferred by the transfer device 30. In the exemplary embodiment, the fixing device 40 applies heat and pressure to a toner image by using the fixing nip NF formed of a fixing belt 411 wound around plural rollers 413 and a pressure roller 42, thereby fixing the toner image onto the recording medium P. A roller 413H is a heating roller that has a heater therein and that is rotated by a driving force transmitted from a motor (not illustrated). Accordingly, the fixing belt 411 rotates in the direction indicated by arrow R.

Medium Transport Device

As illustrated in FIG. 8, the medium transport device 50 includes the medium supplying section 52, the medium output section 54, the medium returning section 56, and the intermediate transport section 58.

The medium supplying section 52 supplies sheets of the recording medium P one after another to the transfer nip NT of the image forming section 12 in synchronization with a transfer timing. The medium output section 54 outputs the recording medium P onto which a toner image has been fixed by the fixing device 40 to the outside of the apparatus. The medium returning section 56 reverses the front and back sides of the recording medium P and returns the recording medium P to the image forming section 12 (medium supplying section 52) when forming an image on the other side of the recording medium P one side of which has a toner image fixed thereonto. The intermediate transport section 58 transports the recording medium P from the transfer device 30 accommodated in the first housing 91 to the fixing device 40 accommodated in the second housing 92, as described above.

The medium supplying section 52 includes, for example, containers 521 in which recording media such as sheets are stacked and accommodated. In the exemplary embodiment, two containers 521 are arranged along the width direction of the apparatus below the transfer device 30. Each of the containers 521 has a bottom plate 5211 on which the recording medium P is placed. The bottom plate 5211 moves downward when the container 521 is drawn from the first housing 91 to the front side in the depth direction of the apparatus. As a result of the downward movement of the bottom plate 5211, a space is formed into which the recording medium P is supplied by a user. The bottom plate 5211 moves upward when the container 521 is pushed back into the first housing 91. At this time, the bottom plate 5211 moves upward until the top sheet of the recording medium P on the bottom plate 5211 comes into contact with a feed roller 523, which will be described below.

A medium supply path 52P, which is formed of plural pairs of transport rollers 522 and a guide (not illustrated), extends from each of the containers 521 to the transfer nip NT, which is a second transfer position. The medium supply path 52P turns in the width direction of the apparatus at two turning points 52P1 and 52P2 and extends upward to the transfer nip NT, so as to substantially form an S shape.

The feed roller 523 is disposed on the upper side of each container 521. The feed roller 523 feeds the recording medium P from the corresponding container 521 to the medium supply path 52P. Among the plural pairs of transport rollers 522, a pair of transport rollers 522S on the uppermost stream side in the transport direction of the recording medium P functions as separation rollers that separate sheets of the recording medium P fed in an overlapped manner from the container 521 by the feed roller 523 into individual sheets. Also, among the plural pairs of transport rollers 522, a pair of transport rollers 522R at a position immediately upstream of the transfer nip NT in the transport direction of the recording medium P operates so that the movement timing of a toner image on the transfer belt 31 is synchronized with the transport timing of the recording medium P.

The medium supplying section 52 includes an auxiliary transport path 52Pr. The auxiliary transport path 52Pr extends from an opening 91W on the side opposite to the second housing 92 of the first housing 91, and joins to the turning point 52P2 on the downstream side in the transport direction of the recording medium P among the two turning points of the medium supply path 52P. The auxiliary transport path 52Pr serves as a transport path for transporting, to the image forming section 12, the recording medium P fed from an optional recording medium supplying device (not illustrated) disposed next to the opening 91W of the first housing 91.

As illustrated in FIG. 7, the intermediate transport section 58 includes plural endless transport belts 581, which are disposed between the transfer nip NT of the transfer device 30 and the fixing nip NF of the fixing device 40. Each of the transport belts 581 is wound around plural rollers 582, and is supported so as to be rotatable in an attitude of being long in the width direction of the apparatus and flat in the height direction of the apparatus in the front view. Among the plural rollers 582, a roller 582D functions as a drive roller that rotates the transport belt 581 in the direction indicated by arrow B using the power of a motor (not illustrated). The plural transport belts 581 and rollers 582 form a medium supply path 58P that extends from the transfer nip NT of the transfer device 30 to the fixing nip NF of the fixing device 40.

Though not illustrated, the intermediate transport section 58 has a configuration of realizing a suction function of sucking air from the inside of each transport belt 581 (negative-pressure suction) and attracting the recording medium P onto the surface of the transfer belt 581. The intermediate transport section 58 transports, from the transfer nip NT to the fixing nip NF, the recording medium P one side of which has a toner image transferred by the transfer device 30, by rotating the transport belts 581 that attract the other side of the recording medium P (the side having no toner image).

As illustrated in FIG. 8, the medium output section 54 outputs the recording medium P to which a toner image has been fixed by the fixing device 40 of the image forming section 12, to the outside of the housing 90 from an outlet 92W at the end of the second housing 92 opposite to the first housing 91. The medium output section 54 includes the output medium receiver 541 for receiving the recording medium P output from the outlet 92W. In a case where an optional device for receiving the recording medium P from the outlet 92W of the second housing 92 is provided, the output medium receiver 541 is removed. In this configuration, the medium output section 54 functions as a supplying unit for supplying the recording medium P to the optional device.

The medium output section 54 includes a medium output path 54P for transporting the recording medium P from the fixing device 40 (fixing nip NF) to the outlet 92W. The medium output path 54P includes plural pairs of rollers 542, a transport belt 543, rollers 544 around which the transport belt 543 is wound, and a guide (not illustrated). The medium output path 54P extends linearly in the width direction of the apparatus. Among the plural pairs of rollers 542, a pair of rollers 542E on the downmost stream side in the output direction of the recording medium P functions as output rollers for outputting the recording medium P onto the output medium receiver 541.

The medium returning section 56 includes plural pairs of rollers 561. The plural pairs of rollers 561 form a reverse path 56P to which the recording medium P that has passed through the image examining section 66 is supplied when double-sided image formation is requested. The reverse path 56P includes a branch path 56P1, a transport path 56P2, and a reverse path 56P3. The branch path 56P1 branches off from the medium output path 54P. The transport path 56P2 transports the recording medium P received from the branch path 56P1 to the medium supply path 52P. The reverse path 56P3 is provided along a part of the transport path 56P2, and reverses the transport direction of the recording medium P transported along the transport path 56P2, thereby reversing the front and back sides of the recording medium P (by using switchback transport).

Post Processing Section

The medium cooling section 62, the correcting device 64, and the image examining section 66 included in the post processing section 60 are disposed in this order from the upstream side in the output direction, on the upstream side in the output direction of the recording medium P with respect to the branch portion of the branch path 56P1 along the medium output path 54P of the medium output section 54. The medium cooling section 62 cools the recording medium P that is being output by the medium output section 54. The correcting device 64 corrects the shape of the recording medium P that is being output by the medium output section 54. The image examining section 66 examines an image formed on the recording medium P that is being output by the medium output section 54.

The medium cooling section 62 includes a heat absorbing device 621 that absorbs heat of the recording medium P, and a pressing device 622 that presses the recording medium P against the heat absorbing device 621. The heat absorbing device 621 is on the upper side with respect to the medium output path 54P, and the pressing device 622 is on the lower side with respect to the medium output path 54P.

The heat absorbing device 621 includes an endless heat absorbing belt 6211, plural rollers 6212 for supporting the heat absorbing belt 6211, a heat sink 6213 disposed inside the heat absorbing belt 6211, and a fan 6214 for cooling the heat sink 6213.

The outer surface of the heat absorbing belt 6211 comes into contact with the recording medium P in a heat-exchangeable manner. Among the plural rollers 6212, a roller 6212D functions as a drive roller for transmitting a driving force to the heat absorbing belt 6211. The heat sink 6213 surface-contacts the inner surface of the heat absorbing belt 6211 in a slidable manner in a certain range along the medium output path 54P. The heat sink 6213 is made of aluminum or aluminum alloy, for example. The fan 6214 generates air flows for exchanging heat with the heat sink 6213. Accordingly, the heat absorbing device 621 radiates the heat removed from the recording medium P by using the heat absorbing belt 6211 into the air flows generated by the fan 6214, via the heat sink 6213.

The pressing device 622 includes an endless pressing belt 6221 and plural rollers 6222 for supporting the pressing belt 6221. The pressing device 622 transports the recording medium P in conjunction with the heat absorbing belt 6211, while pressing the recording medium P against the heat absorbing belt 6211 (heat sink 6213). The pressing belt 6221 is wound around the plural rollers 6222.

The correcting device 64 is provided on the downstream side of the medium cooling section 62 in the medium output section 54. The correcting device 64 corrects a curl of the recording medium P received from the medium cooling section 62.

An inline sensor 661, which is included in the image examining section 66, is disposed on the downstream side of the correcting device 64 in the medium output section 54. The inline sensor 661 detects whether or not there is a defect in toner density, image, image position, or the like of a fixed toner image, and the degree of such a defect by using light reflected by the recording medium P.

Image Formation Operation

Now, the outline of a process of forming an image on the recording medium P and post processing thereof performed by the image forming apparatus 10 will be described.

Upon receiving an image formation instruction, the controller 70 activates the toner image forming section 20, the transfer device 30, and the fixing device 40. Accordingly, the photoconductor drums 21 and the developing rollers 242 of the image forming units 14 for the respective colors are rotated, and thereby the transfer belt 31 is rotated. Also, the pressure roller 42 is rotated, and the fixing belt 411 is rotated. Furthermore, in synchronization with these operations, the controller 70 activates the medium transport device 50 and so forth.

Accordingly, the photoconductor drums 21 for the respective colors are charged by the respective charging devices 22 while being rotated. Also, the controller 70 transmits image data processed by the image signal processor 71 to the respective exposure devices 23. The exposure devices 23 emit exposure light L in accordance with the image data, so that the respective photoconductor drums 21 that are charged are exposed to the exposure light L. Accordingly, electrostatic latent images are formed on the surfaces of the respective photoconductor drums 21. The electrostatic latent images formed on the respective photoconductor drums 21 are developed by using a developer supplied from the developing devices 24. Accordingly, a toner image of a corresponding one of the colors including the first special color (V), the second special color (W), yellow (Y), magenta (M), cyan (C), and black (K) is formed on each of the photoconductor drums 21 for the respective colors.

The toner images of the respective colors formed on the photoconductor drums 21 for the respective colors are sequentially transferred onto the transfer belt 31, which is rotating, in accordance with the application of a transfer bias voltage via the first transfer rollers 33 for the respective colors. Accordingly, a superimposed toner image formed of the toner images of the six colors superimposed on one another is formed on the transfer belt 31. The superimposed toner image is transported to the transfer nip NT along with the rotation of the transfer belt 31. The transfer nip NT is supplied with the recording medium P by the pair of transport rollers 522R of the medium supplying section 52 in synchronization with the transport timing of the superimposed toner image. The application of a transfer bias voltage at the transfer nip NT causes the superimposed toner image to be transferred from the transfer belt 31 onto the recording medium P.

The recording medium P having the toner image transferred thereonto is transported from the transfer nip NT of the transfer device 30 toward the fixing nip NF of the fixing device 40 by the intermediate transport section 58 under a negative-pressure suction condition. The fixing device 40 applies heat and pressure force (fixing energy) to the recording medium P passing through the fixing nip NF. Accordingly, the toner image transferred onto the recording medium P is fixed to the recording medium P.

The recording medium P output from the fixing device 40 undergoes processing performed by the post processing section 60 while being transported by the medium output section 54 toward the output medium receiver 541 outside the apparatus. The recording medium P heated in the fixing process is first cooled in the medium cooling section 62. Subsequently, the recording medium P is corrected to eliminate a curl. Furthermore, the image examining section 66 detects whether or not the toner image fixed to the recording medium P has a defect in toner density, image, image position, or the like, and the degree of such a defect. Then, the recording medium P is output to the medium output section 54.

On the other hand, in the case of forming an image on a no-image face having no image of the recording medium P (in the case of double-sided printing), the controller 70 switches the transport path for the recording medium P after the image examining section 66, from the medium output path 54P of the medium output section 54 to the branch path 56P1 of the medium returning section 56. Accordingly, the recording medium P is supplied to the medium supply path 52P via the reverse path 56P, with the front and back sides thereof being reversed. An image is formed on and fixed to the back side of the recording medium P in a process similar to the above-described image formation process performed on the front side. The recording medium P undergoes a process similar to the post processing of image formation performed on the front side, and is output to the output medium receiver 541 outside the apparatus by the medium output section 54.

Configuration of Controller

Next, description will be given of the configuration of the controller 70 and so forth in the case of activating an inactive image forming unit 14, and the configuration of the controller 70 and so forth in the case of inactivating an active image forming unit 14.

In the above-described image formation operation, the six image forming units 14V, 14W, 14Y, 14M, 14C, and 14K are activated. However, the controller 70 according to the exemplary embodiment inactivates an image forming unit 14 which is not required to be in an active state. For example, in the case of outputting a color image whose surface is not glossy without using a user-specific corporate color, the controller 70 activates the image forming units 14Y, 14M, 14C, and 14K, and causes the image forming units 14V and 14W to be in an inactive state. Accordingly, the toner image forming section 20 operates in a 4C mode, in which the four image forming units 14 have been activated.

In contrast, in the case of outputting a color image whose surface is glossy by using the above-mentioned corporate color, the controller 70 activates the image forming units 14V, 14W, 14Y, 14M, 14C, and 14K. Accordingly, the toner image forming section 20 operates in a 6C mode, in which all six image forming units 14 have been activated.

Here, description will be given of the configuration of the controller 70 and so forth in the case of changing the operation mode of the toner image forming section 20 from the 4C mode to the 6C mode and further changing the operation mode from the 6C mode to the 4C mode.

Figure 3:
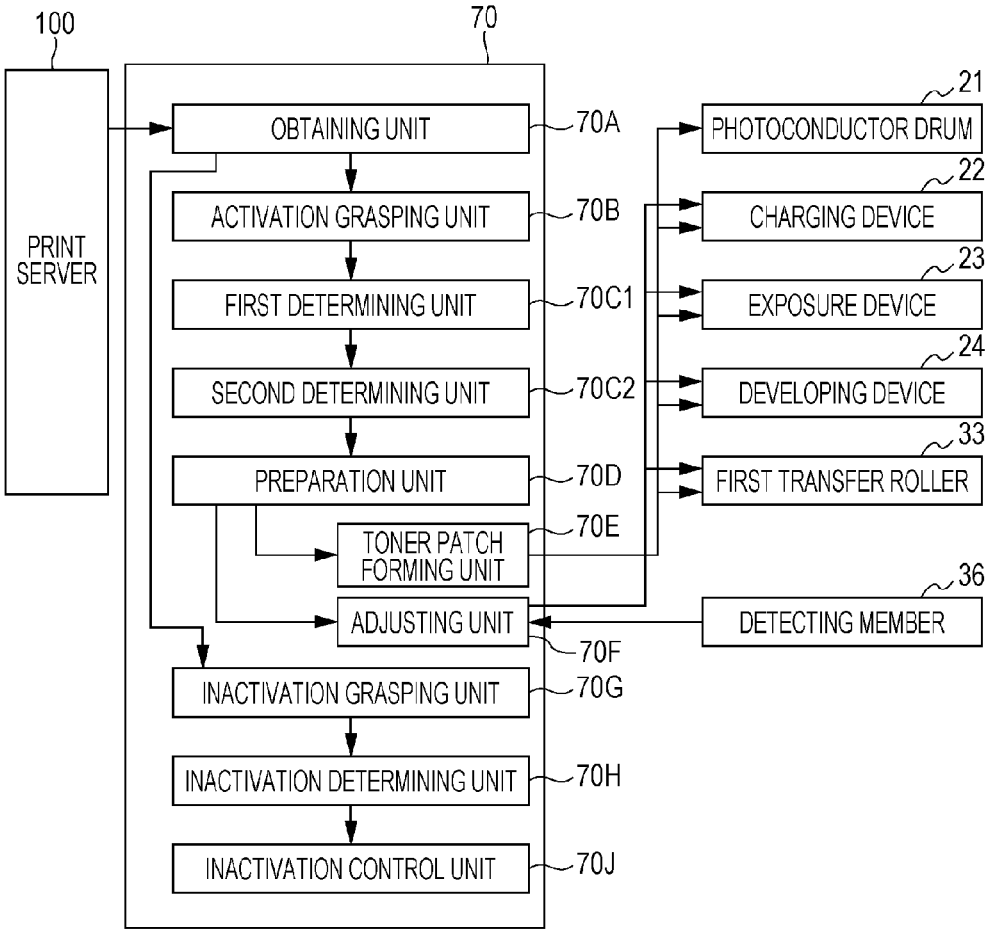
FIG. 3 is a block diagram illustrating control performed by a controller for changing the mode from the 4C mode to the 6C mode in the image forming apparatus according the exemplary embodiment of the present invention.

The configuration of the controller 70 in the case of activating an inactive image forming unit 14 will be described with reference to the functional block diagram in FIG. 3. As illustrated in FIG. 3, the controller 70 includes an obtaining unit 70A, an activation grasping unit 70B, a first determining unit 70C1 as an example of a determining unit, a second determining unit 70C2, a preparation unit 70D, a toner patch forming unit 70E as an example of a preliminary toner image forming unit, an adjusting unit 70F, an inactivation grasping unit 70G, an inactivation determining unit 70H, and an inactivation control unit 70J.

Also, as will be described below, a detecting member 36 (see FIG. 7) is provided in the image forming apparatus 10. The detecting member 36 is an example of a detecting unit that detects a toner patch formed on the transfer belt 31 by the toner patch forming unit 70E. As will be described below, the adjusting unit 70F adjusts the quality of toner images to be formed by the image forming units 14 in accordance with a result of detection performed by the detecting member 36.

First, the detecting member 36 will be described. Then, the obtaining unit 70A, the activation grasping unit 70B, the first determining unit 70C1, the second determining unit 70C2, the preparation unit 70D, the toner patch forming unit 70E, the adjusting unit 70F, the inactivation grasping unit 70G, the inactivation determining unit 70H, and the inactivation control unit 70J included in the controller 70 will be described. A toner patch as an example of a preliminary toner image will be described below with reference to a flowchart.

An optical sensor is used as the detecting member 36. As illustrated in FIG. 7, the detecting member 36 is disposed on the downstream side of the image forming unit 14K in the rotation direction of the transfer belt 31 so as to face the outer surface of the transfer belt 31.

The detecting member 36 detects a toner patch that is formed on the transfer belt 31 and that moves along with the rotation of the transfer belt 31. The specific configuration of the detecting member 36 will be described below with reference to the flowchart.

As illustrated in FIG. 3, the obtaining unit 70A obtains, from a print server 100 outside the image forming apparatus 10, information regarding an image to be output from the image forming apparatus 10. The print server 100 stores image output instructions (jobs) provided from plural client computers, and manages the stored image output instructions so that the image forming apparatus 10 may form toner images on the recording medium P in a correct order.

The activation grasping unit 70B grasps, from the information obtained by the obtaining unit 70A, an estimated activation timing at which the image forming units 14V and 14W that are in an inactive state are to be activated. That is, the activation grasping unit 70B determines the image output instruction (job) corresponding to the timing at which the image forming units 14V and 14W are to be activated, and grasps an estimated activation timing at which the image forming units 14V and 14W are to be activated. The details of the control of the activation grasping unit 70B will be described below with reference to the flowchart.

The first determining unit 70C1 determines whether or not the time period until the estimated activation timing grasped by the activation grasping unit 70B has become equal to an image quality adjustment period. Here, the image quality adjustment period is a time period that is set as a time period necessary for adjusting, by using the toner patch forming unit 70E, the detecting member 36, and the adjusting unit 70F, the quality of toner images to be formed by the image forming units 14V and 14W that are in an inactive state. The details of the control of the first determining unit 70C1 will be described below with reference to the flowchart.

If the first determining unit 70C1 determines that the time period until the estimated activation timing has become equal to the image quality adjustment period, the second determining unit 70C2 calculates the time period from the preceding quality adjustment of toner images for the image forming units 14V and 14W that are in an inactive state until the estimated activation timing. Also, the second determining unit 70C2 determines whether or not the calculated time period is equal to or shorter than a threshold (for example, 60 seconds). The details of the control of the second determining unit 70C2 will be described below with reference to the flowchart.

The toner patch forming unit 70E causes the image forming units 14V and 14W that are in an inactive state to form a toner patch for adjusting image quality and causes the toner patch to be transferred onto the transfer belt 31, which is rotating, before the inactive image forming units 14V and 14W are activated to form toner images. The details of the control of the toner patch forming unit 70E will be described below with reference to the flowchart.

The adjusting unit 70F adjusts the quality (density, tone, etc.) of toner images to be formed by the image forming units 14V and 14W in accordance with a result of detection in which the toner patch has been detected by the detecting member 36. More specifically, the adjusting unit 70F adjusts the intensity of exposure light L emitted by the exposure device 23, the charging voltage of the charging device 22, the transfer voltage of the first transfer rollers 33, etc. The details of the control of the adjusting unit 70F will be described below with reference to the flowchart.

The preparation unit 70D causes the toner patch forming unit 70E to transfer the toner patch onto the transfer belt 31 while a toner image is being formed by an active image forming unit 14 before the estimated activation timing of the image forming units 14V and 14W arrives. Furthermore, the preparation unit 70D causes the adjusting unit 70F to adjust the quality of the toner images to be formed by the image forming units 14V and 14W in accordance with a result of detection in which the detecting member 36 has detected the toner patch. The details of the control of the preparation unit 70D will be described below with reference to the flowchart.

The inactivation grasping unit 70G grasps, from the information re-obtained by the obtaining unit 70A, an estimated inactivation timing at which the image forming units 14V and 14W that are in an active state are to be inactivated and an estimated reactivation timing at which the image forming units 14V and 14W to be inactivated are to be reactivated. The details of the control of the inactivation grasping unit 70G will be described below with reference to the flowchart.

The inactivation determining unit 70H calculates, using the estimated inactivation timing and the estimated reactivation timing grasped by the inactivation grasping unit 70G, an estimated inactivation period over which the image forming units 14V and 14W are inactive. Furthermore, the inactivation determining unit 70H determines whether or not the estimated inactivation period is longer than the image quality adjustment period that is necessary for adjusting the quality of toner images to be formed by the image forming units 14V and 14W. The details of the control of the inactivation determining unit 70H will be described below with reference to the flowchart.

If the inactivation determining unit 70H determines that the estimated inactivation period is longer than the image quality adjustment period by a certain time period (including zero seconds) or more, the inactivation control unit 70J inactivates the image forming units 14V and 14W at the estimated inactivation timing. On the other hand, if the inactivation determining unit 70H determines that the estimated inactivation period is equal to or shorter than the image quality adjustment period, the inactivation control unit 70J does not inactivate the image forming units 14V and 14W at the estimated inactivation timing (causes the image forming units 14V and 14W to be in an active state but not to form a toner image). The details of the control of the inactivation control unit 70J will be described below with reference to the flowchart.

Operation of Controller

Next, description will be given of a flow of a process of the productivity enhancement program that is executed by the controller 70 in the case of changing the operation mode of the toner image forming section 20 from the 4C mode to the 6C mode and in the case of changing the operation mode of the toner image forming section 20 from the 6C mode to the 4C mode, with reference to the flowchart illustrated in FIGS. 1 and 2, and other figures.

First, description will be given of the case of changing the operation mode of the toner image forming section 20 from the 4C mode to the 6C mode. As illustrated in FIGS. 1 and 3, in step 100, the obtaining unit 70A obtains information regarding an image to be output from the image forming apparatus 10 (JOB information) from the print server 100. After the obtaining unit 70A has obtained the JOB information, the process proceeds to step 200.

In step 200, the activation grasping unit 70B grasps, from the JOB information obtained by the obtaining unit 70A, an estimated activation timing at which the image forming units 14V and 14W that are in an inactive state are to activated. After the activation grasping unit 70B has grasped the estimated activation timing of the image forming units 14V and 14W, the process proceeds to step 300.

In step 300, the first determining unit 70C1 determines whether or not the time period until the estimated activation timing grasped by the activation grasping unit 70B has become equal to an image quality adjustment period. If the first determining unit 70C1 determines that the time period until the estimated activation timing has become equal to the image quality adjustment period, the process proceeds to step 400. If the first determining unit 70C1 determines that the time period until the estimated activation timing has not become equal to the image quality adjustment period (the time period is longer than the image quality adjustment period), the process returns to step 100, and the above-described steps are performed.

In step 400, the second determining unit 70C2 calculates the time period from the end of the preceding quality adjustment of a toner image for the image forming units 14V and 14W that are in an inactive state until the estimated activation timing. Then, the second determining unit 70C2 determines whether or not the calculated time period is equal to or shorter than a threshold (for example, 60 seconds).

If the second determining unit 70C2 determines that the time period from the preceding image quality adjustment for the image forming units 14V and 14W until the estimated activation timing is longer than the threshold, the process proceeds to step 500.

In step 500, the preparation unit 70D controls the toner patch forming unit 70E and the adjusting unit 70F while a toner image is being formed by an active image forming unit 14 before the estimated activation timing of the image forming units 14V and 14W arrives. Furthermore, the preparation unit 70D causes the toner patch forming unit 70E and the adjusting unit 70F to adjust the quality of the toner images to be formed by the image forming units 14V and 14W that are in an inactive state. Hereinafter, the details of image quality adjustment will be described.

The preparation unit 70D causes the toner patch forming unit 70E to transfer a toner patch onto the transfer belt 31.

Specifically, as illustrated in FIG. 6, the toner patch forming unit 70E causes the photoconductor drums 21V and 21W to be rotated and causes the charging devices 22V and 22W to charge the surfaces of the photoconductor drums 21V and 21W. Furthermore, the toner patch forming unit 70E causes the exposure devices 23V and 23W to form preliminary electrostatic latent images on the surfaces of the charged photoconductor drums 21V and 21W. Also, the toner patch forming unit 70E causes the developing devices 24V and 24W to develop the preliminary electrostatic latent images formed on the surfaces of the photoconductor drums 21V and 21W to generate toner patches 38V and 38W, and causes the first transfer rollers 33V and 33W to transfer the toner patches 38V and 38W on the photoconductor drums 21V and 21W onto the outer surface of the transfer belt 31.

Figure 5:
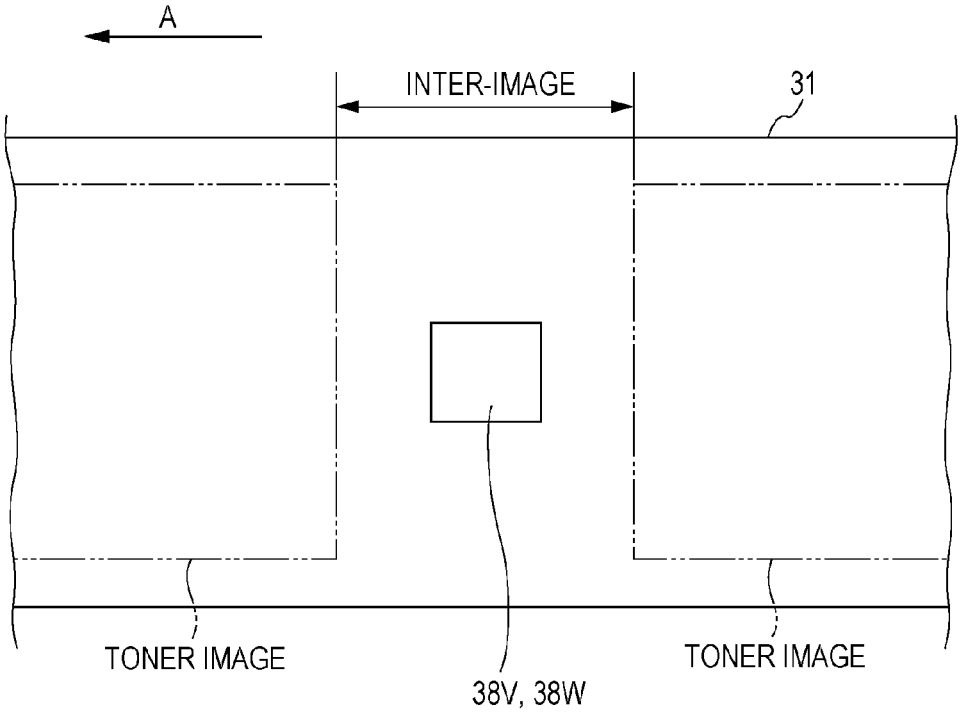
FIG. 5 is a plan view illustrating a state where a toner patch for adjusting image quality has been transferred onto a transfer belt in the image forming apparatus according the exemplary embodiment of the present invention.

Here, the toner patches 38V and 38W are transferred to a position between a toner image and a toner image (inter-image) that are transferred onto the transfer belt 31 by the image forming units 14 that are operating in the 4C mode (see FIG. 5). That is, the image quality adjustment for the image forming units 14V and 14W is performed in parallel with the operation in the 4C mode.

Then, the toner patches 38V and 38W are transported by the transfer belt 31, which is rotating, and face the detecting member 36. The detecting member 36 detects the toner patches 38V and 38W transported by the transfer belt (see FIG. 7).

Furthermore, the preparation unit 70D causes the adjusting unit 70F to adjust the quality (density, tone, etc.) of the toner images to be formed by the image forming units 14V and 14W in accordance with the result of detection in which the detecting member 36 has detected the toner patches 38V and 38W. Specifically, the adjusting unit 70F adjusts the intensity of the exposure light L of the exposure device 23, the charging voltage of the charging device 22, the transfer voltage of the first transfer roller 33, and so forth.

After the image quality adjustment by the preparation unit 70D ends, the process proceeds to step 600.

In step 600, the image forming units 14V and 14W for which image quality adjustment has been performed are activated, and thereby the toner image forming section 20 is operated in the 6C mode.

On the other hand, if the second determining unit 70C2 determines in step 400 that the time period from the preceding image quality adjustment for the image forming units 14V and 14W until the estimated activation timing is equal to or shorter than the threshold, the process proceeds to step 700.

In step 700, the preparation unit 70D activates the image forming units 14V and 14W without performing quality adjustment on the toner images to be formed by the image forming units 14V and 14W that are in an inactive state, thereby operating the toner image forming section 20 in the 6C mode. In this case, the result of the preceding quality adjustment of toner images is used for the intensity of the exposure light L of the exposure device 23, the charging voltage of the charging device 22, the transfer voltage of the first transfer roller 33, and so forth.

Next, description will be given of the operation of the controller 70 and so forth in the case of changing the operation mode of the toner image forming section 20 from the 6C mode to the 4C mode.

Figure 2:
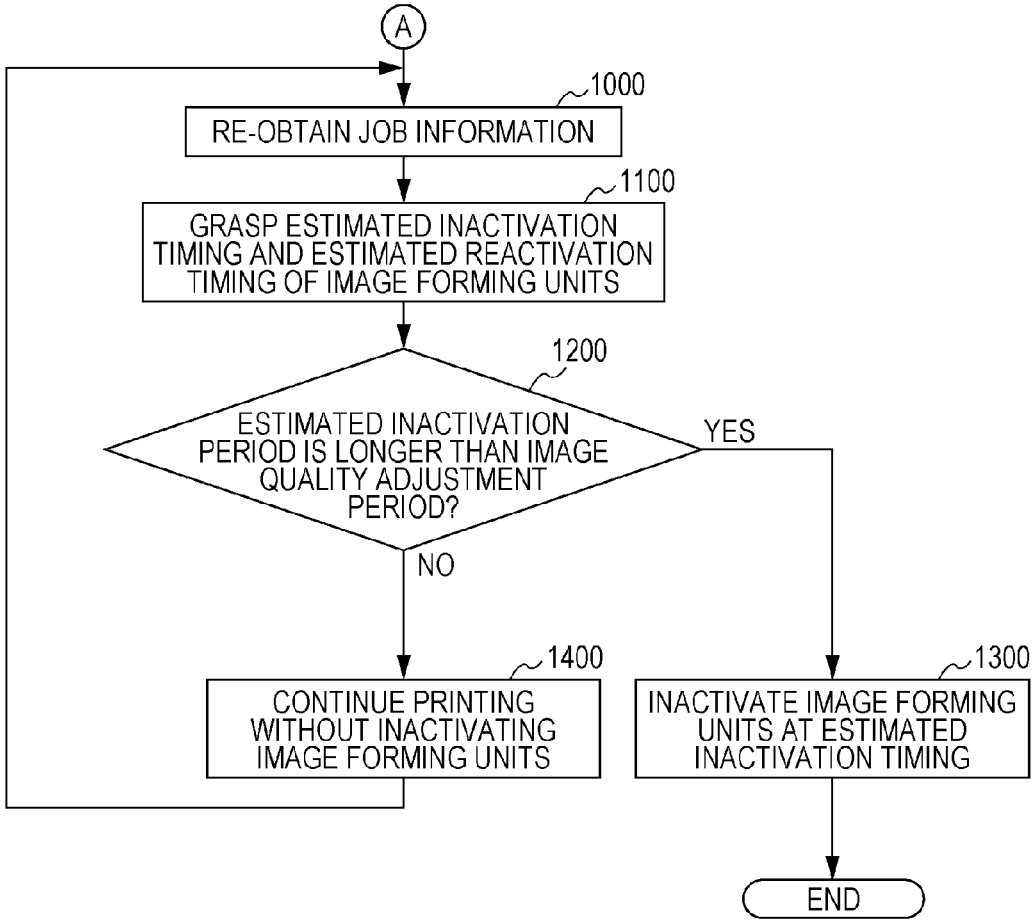
FIG. 2 is a flowchart illustrating a process of changing the mode from the 6C mode to the 4C mode in the image forming apparatus according the exemplary embodiment of the present invention.

As illustrated in FIGS. 2 and 3, in step 1000, the obtaining unit 70A re-obtains, from the print server 100, information regarding an image to be output from the image forming apparatus 10 (JOB information). After the obtaining unit 70A has re-obtained the JOB information, the process proceeds to step 1100.

In step 1100, the inactivation grasping unit 70G grasps, from the JOB information re-obtained by the obtaining unit 70A, an estimated inactivation timing at which the image forming units 14V and 14W that are in an active state are to be inactivated and an estimated reactivation timing at which the image forming units 14V and 14W that are to be inactivated are to be reactivated. After the inactivation grasping unit 70G has grasped the estimated inactivation timing and the estimated reactivation timing, the process proceeds to step 1200.

In step 1200, the inactivation determining unit 70H calculates, using the estimated inactivation timing and the estimated reactivation timing grasped by the inactivation grasping unit 70G, an estimated inactivation period over which the image forming units 14V and 14W are inactive. Furthermore, the inactivation determining unit 70H determines whether or not the estimated inactivation period is longer than the image quality adjustment period, which is necessary for adjusting the quality of a toner image, by a certain time period or more.

If the inactivation determining unit 70H determines that the estimated inactivation period is longer than the image quality adjustment period by the certain time period or more, the process proceeds to step 1300.

In step 1300, the inactivation control unit 70J inactivates the image forming units 14V and 14W at the estimated inactivation timing, and the operation ends.

On the other hand, if the inactivation determining unit 70H determines in step 1200 that the estimated inactivation period is not longer than the image quality adjustment period by the certain time period or more, the process proceeds to step 1400.

In step 1400, the inactivation control unit 70J does not inactivate the image forming units 14V and 14W and continues an image formation operation, and the process returns to step 1000.

As described above, image quality adjustment for the image forming units 14V and 14W that are in an inactive state is performed while a toner image is being formed by an active image forming unit 14 before an estimated activation timing arrives. Accordingly, in the case of activating the image forming units 14V and 14W that are in an inactive state to cause the image forming units 14V and 14W to output a toner image, a switch period for switching the image forming unit 14 to be activated may be shortened.

Specifically, if image quality adjustment is started after the estimated activation timing at which the image forming units 14V and 14W that are in an inactive state are activated, a lot of time is necessary to form the toner patches 38V and 38W (preliminary toner images) for adjusting image quality and transport the toner patches 38V and 38W to the position facing the detecting member 36, particularly in a large image forming apparatus, such as the image forming apparatus 10 illustrated in FIG. 8. A switch period lasts until image quality adjustment based on the result generated by the detecting member 36 ends, and thus a long time period is necessary before starting image formation.

Thus, as in the configuration described above, image quality adjustment for the image forming units 14V and 14W that are in an inactive state is performed in parallel with image formation performed by an active image forming unit 14. Accordingly, a waiting time necessary for forming the toner patches 38V and 38W for adjusting image quality and transporting the toner patches 38V and 38W to the position facing the detecting member 36 may be eliminated from the switch period. Accordingly, the switch period for switching the image forming unit 14 to be activated may be shortened.

Figure 4A:
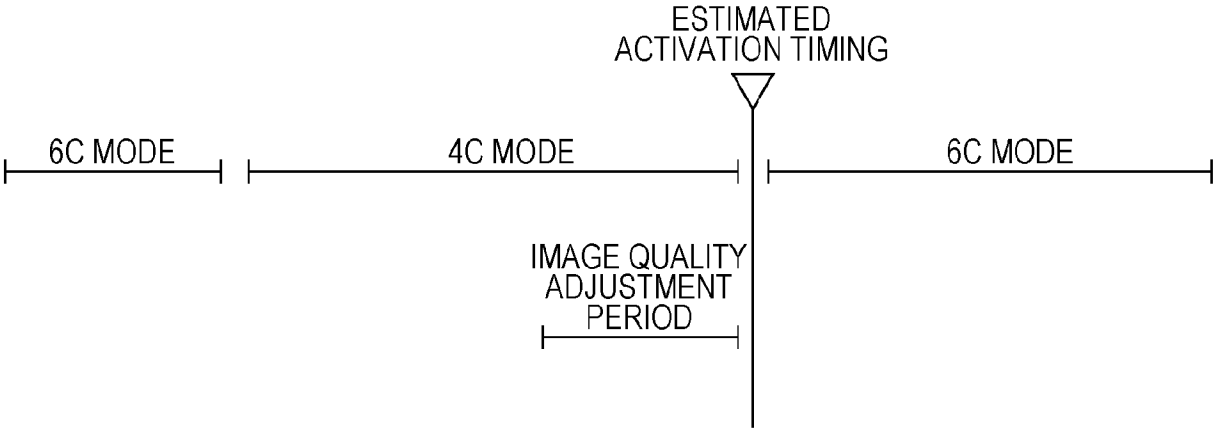
FIGS. 4A and 4B are charts illustrating a process of changing the mode from the 4C mode to the 6C mode in the image forming apparatus according the exemplary embodiment of the present invention and an image forming apparatus according to a comparative example.
Figure 4B:
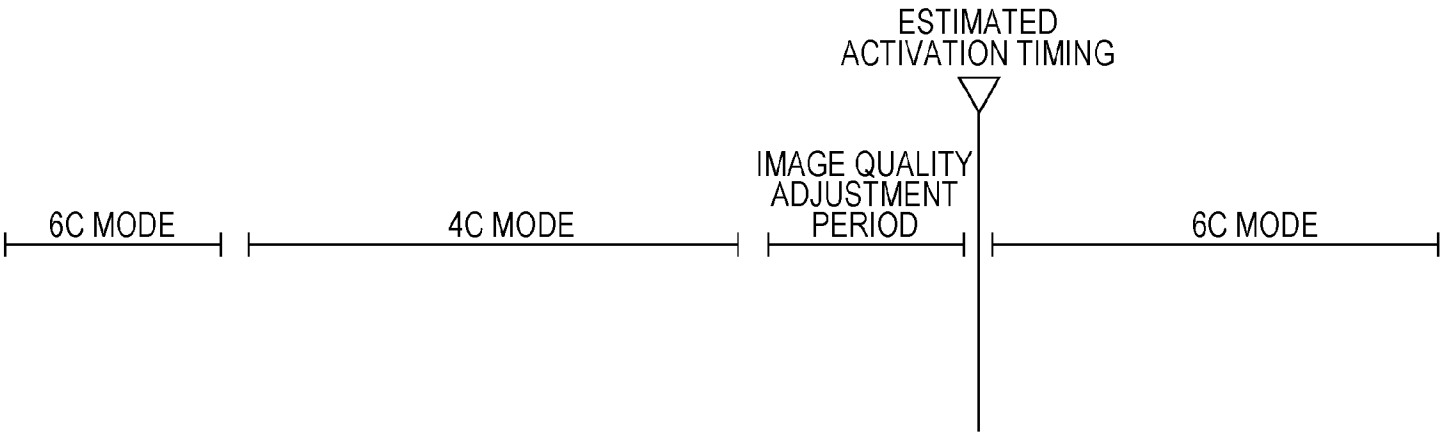

Also, image quality adjustment for the image forming units 14V and 14W is performed in parallel with the operation in the 4C mode (see FIG. 4A). Thus, the timing at which the mode is switched to the 6C mode (estimated activation timing) is earlier compared to the case where the image quality adjustment is performed in series with the operation in the 4C mode (see FIG. 4B). That is, the productivity per unit time may be enhanced.

Also, the quality of toner images to be formed by the image forming units 14V and 14W is adjusted before an estimated activation timing. Accordingly, the quality of toner images may be enhanced in the case of activating the image forming units 14V and 14W that are in an inactive state.

The image quality adjustment for the image forming units 14V and 14W is performed only if the time period from the preceding quality adjustment of toner images for the image forming units 14V and 14W that are in an inactive state until the estimated activation timing is longer than the threshold. If the time period from the preceding quality adjustment of toner images for the image forming units 14V and 14W that are in an inactive state until the estimated activation timing is equal to or shorter than the threshold, the result of the preceding image quality adjustment of toner images is used. Accordingly, operations for adjusting image quality may be reduced compared to the case of performing image quality adjustment for the image forming units each time.

The inactivation control unit 70J inactivates the image forming units 14V and 14W at an estimated inactivation timing only if it is determined that the estimated inactivation period of the image forming units 14V and 14W is longer than the image quality adjustment period. Accordingly, the load of the image forming units 14V and 14W caused by inactivation and activation may be reduced.

The specific exemplary embodiment of the present invention has been described above. It is obvious for those skilled in the art that the present invention is not limited to the specific exemplary embodiment, and other various embodiments may be carried out without deviating from the scope of the present invention. For example, the second determining unit 70C2 is used in the foregoing exemplary embodiment, but the second determining unit 70C2 may not be used. For example, if the first determining unit 70C1 determines in step 300 that the time period until the estimated activation timing has become equal to the image quality adjustment period, the process may proceed to step 500.

In the foregoing exemplary embodiment, the toner patches 38V and 38W are transferred to an inter-image. Instead of using the inter-image, a toner patch may be formed between the last toner image of a certain job and the first toner image of the subsequent job. Alternatively, a toner patch having a toner density of plural gradation levels may be transferred onto a transfer belt.

In the foregoing exemplary embodiment, the configuration has been described using an example in which the mode is changed from the 4C mode to the 6C mode. For example, the above-described configuration may be applied to the case of changing the mode from a monochrome mode (1C mode) to the 4C mode or 6C mode.

In the foregoing exemplary embodiment, the configuration has been described using an example in which the mode is changed from the 6C mode to the 4C mode. For example, the above-described configuration may be applied to the case of changing the mode from the 4C mode or 6C mode to a monochrome mode (1C mode).

Figure 1:
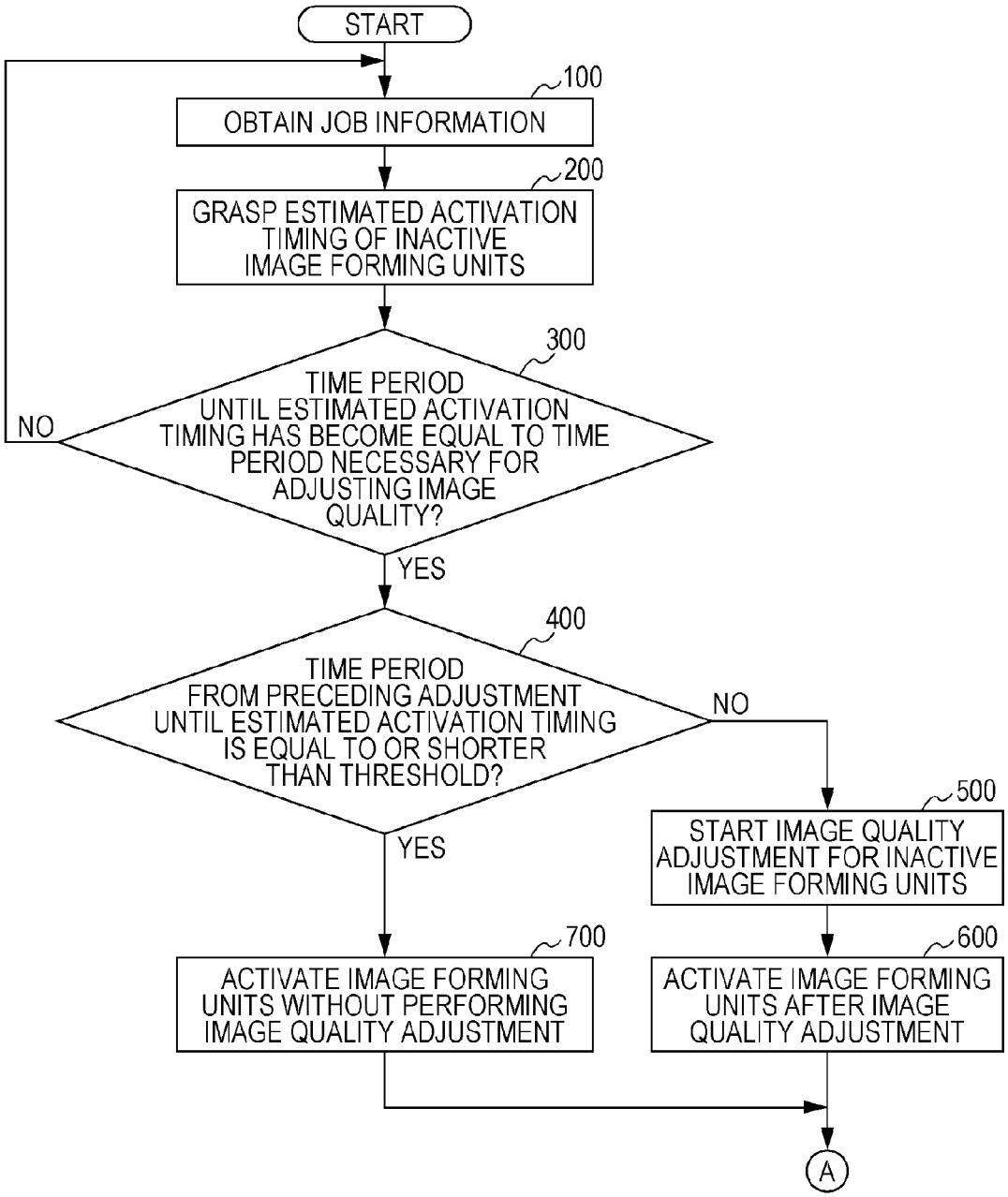
FIG. 1 is a flowchart illustrating a process of changing a mode from a 4C mode to a 6C mode in an image forming apparatus according an exemplary embodiment of the present invention.

In the foregoing exemplary embodiment, the timing to start the flow illustrated in FIG. 1 is not described. The next flow may be started after a certain time period has continued in which a flow is not executed. Alternatively, the next flow may be started after the preceding flow ends.

In the foregoing exemplary embodiment, the obtaining unit 70A re-obtains information regarding an image to be output from the image forming apparatus 10 (JOB information) in step 1000. The obtaining unit 70A may not re-obtain the information. In that case, the inactivation grasping unit 70G may grasp, from the information obtained in step 100, an estimated inactivation timing and an estimated reactivation timing in step 1100.

In the foregoing exemplary embodiment, an estimated reactivation timing is grasped in step 1100. If there is no estimated reactivation timing, the process may proceed to step 1300, where the image forming units 14V and 14W may be inactivated at the estimated inactivation timing.

In the foregoing exemplary embodiment, the productivity enhancement program is installed in advance to the controller 70. Alternatively, the program may be provided by being stored in a computer readable recording medium or may be provided via a wired or wireless communication medium.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a preliminary toner image forming unit that causes an inactive image forming unit, among a plurality of image forming units that are used to form toner images, to form a preliminary toner image for adjusting image quality and causes the preliminary toner image to be transferred onto a transfer body, which is rotating, before the inactive image forming unit is activated to form a toner image;

a detecting unit that detects the preliminary toner image which has been moved along with rotation of the transfer body;

an adjusting unit that adjusts quality of a toner image to be formed by the inactive image forming unit in accordance with a result of detection performed by the detecting unit;

an obtaining unit that obtains information regarding an image to be output from a body of the image forming apparatus;

an activation grasping unit that grasps, from the information obtained by the obtaining unit, an estimated activation timing at which the inactive image forming unit among the plurality of image forming units is to be activated;

a determining unit that determines whether or not a time period until the estimated activation timing grasped by the activation grasping unit has become equal to an image quality adjustment period that is necessary for adjusting, by using the preliminary toner image forming unit, the detecting unit, and the adjusting unit, the quality of the toner image to be formed by the inactive image forming unit; and a preparation unit that, if the determining unit determines that the time period until the estimated activation timing has become equal to the image quality adjustment period, causes the preliminary toner image forming unit to transfer the preliminary toner image onto the transfer body and causes the adjusting unit to adjust the quality of the toner image to be formed by the inactive image forming unit in accordance with the result of detection performed by the detecting unit, while a toner image is being formed by an active image forming unit among the plurality of image forming units before the estimated activation timing grasped by the activation grasping unit arrives.

2. An image forming apparatus comprising:

a preliminary toner image forming unit that causes an inactive image forming unit, among a plurality of image forming units that are used to form toner images, to form a preliminary toner image for adjusting image quality and causes the preliminary toner image to be transferred onto a transfer body, which is rotating, before the inactive image forming unit is activated to form a toner image;

a detecting unit that detects the preliminary toner image which has been moved along with rotation of the transfer body;

an adjusting unit that adjusts quality of a toner image to be formed by the inactive image forming unit in accordance with a result of detection performed by the detecting unit;

an obtaining unit that obtains information regarding an image to be output from a body of the image forming apparatus;

an activation grasping unit that grasps, from the information obtained by the obtaining unit, an estimated activation timing at which the inactive image forming unit among the plurality of image forming units is to be activated;

a first determining unit that determines whether or not a time period until the estimated activation timing grasped by the activation grasping unit has become equal to an image quality adjustment period that is necessary for adjusting, by using the preliminary toner image forming unit, the detecting unit, and the adjusting unit, the quality of the toner image to be formed by the inactive image forming unit;

a second determining unit that determines, if the first determining unit determines that the time period until the estimated activation timing has become equal to the image quality adjustment period, whether or not a time period from preceding quality adjustment of a toner image for the inactive image forming unit until the estimated activation timing is equal to or shorter than a threshold; and a preparation unit that does not cause the adjusting unit to adjust the quality of the toner image to be formed by the inactive image forming unit if the second determining unit determines that the time period from the preceding quality adjustment of a toner image for the inactive image forming unit until the estimated activation timing is equal to or shorter than the threshold, and that, if the second determining unit determines that the time period from the preceding quality adjustment of a toner image for the inactive image forming unit until the estimated activation timing is longer than the threshold, causes the preliminary toner image forming unit to transfer the preliminary toner image onto the transfer body and causes the adjusting unit to adjust the quality of the toner image to be formed by the inactive image forming unit in accordance with the result of detection performed by the detecting unit, while a toner image is being formed by an active image forming unit among the plurality of image forming units before the estimated activation timing grasped by the activation grasping unit arrives.

3. The image forming apparatus according to claim 1, further comprising:

an inactivation grasping unit that grasps, from the information obtained by the obtaining unit, an estimated inactivation timing of a certain image forming unit to be inactivated among active image forming units among the plurality of image forming units and an estimated reactivation timing at which the certain image forming unit is to be reactivated;

an inactivation determining unit that calculates, by using the estimated inactivation timing and the estimated reactivation timing grasped by the inactivation grasping unit, an estimated inactivation period over which the certain image forming unit is inactive, and that determines whether or not the estimated inactivation period is longer than the image quality adjustment period by a certain time period or more; and an inactivation control unit that inactivates the certain image forming unit at the estimated inactivation timing if the inactivation determining unit determines that the estimated inactivation period is longer than the image quality adjustment period by the certain time period or more, and does not inactivate the certain image forming unit at the estimated inactivation timing if the inactivation determining unit determines that the estimated inactivation period is equal to or shorter than the image quality adjustment period.

4. The image forming apparatus according to claim 2, further comprising:

an inactivation grasping unit that grasps, from the information obtained by the obtaining unit, an estimated inactivation timing of a certain image forming unit to be inactivated among active image forming units among the plurality of image forming units and an estimated reactivation timing at which the certain image forming unit is to be reactivated;

an inactivation determining unit that calculates, by using the estimated inactivation timing and the estimated reactivation timing grasped by the inactivation grasping unit, an estimated inactivation period over which the certain image forming unit is inactive, and that determines whether or not the estimated inactivation period is longer than the image quality adjustment period by a certain time period or more; and an inactivation control unit that inactivates the certain image forming unit at the estimated inactivation timing if the inactivation determining unit determines that the estimated inactivation period is longer than the image quality adjustment period by the certain time period or more, and does not inactivate the certain image forming unit at the estimated inactivation timing if the inactivation determining unit determines that the estimated inactivation period is equal to or shorter than the image quality adjustment period.

5. A non-transitory computer readable medium storing a productivity enhancement program causing a computer to execute a process, the process comprising:

causing an inactive image forming unit, among a plurality of image forming units that are used to form toner images, to form a preliminary toner image for adjusting image quality and causing the preliminary toner image to be transferred onto a transfer body, which is rotating, before the inactive image forming unit is activated to form a toner image;

detecting the preliminary toner image which has been moved along with rotation of the transfer body;

adjusting quality of a toner image to be formed by the inactive image forming unit in accordance with a result of detection performed in the detecting;

obtaining information regarding an image to be output from a body of an image forming apparatus;

grasping, from the obtained information, an estimated activation timing at which the inactive image forming unit among the plurality of image forming units is to be activated;

determining whether or not a time period until the grasped estimated activation timing has become equal to an image quality adjustment period that is necessary for adjusting, by using the causing, the detecting, and the adjusting, the quality of the toner image to be formed by the inactive image forming unit; and if it is determined that the time period until the estimated activation timing has become equal to the image quality adjustment period, causing the preliminary toner image to be transferred onto the transfer body and causing the quality of the toner image to be formed by the inactive image forming unit to be adjusted in accordance with the result of detection performed in the detecting, while a toner image is being formed by an active image forming unit among the plurality of image forming units before the grasped estimated activation timing arrives.

6. A non-transitory computer readable medium storing a productivity enhancement program causing a computer to execute a process, the process comprising:

causing an inactive image forming unit, among a plurality of image forming units that are used to form toner images, to form a preliminary toner image for adjusting image quality and causing the preliminary toner image to be transferred onto a transfer body, which is rotating, before the inactive image forming unit is activated to form a toner image;

detecting the preliminary toner image which has been moved along with rotation of the transfer body;

adjusting quality of a toner image to be formed by the inactive image forming unit in accordance with a result of detection performed in the detecting;

obtaining information regarding an image to be output from a body of an image forming apparatus;

grasping, from the obtained information, an estimated activation timing at which the inactive image forming unit among the plurality of image forming units is to be activated;

determining whether or not a time period until the grasped estimated activation timing has become equal to an image quality adjustment period that is necessary for adjusting, by using the causing, the detecting, and the adjusting, the quality of the toner image to be formed by the inactive image forming unit;

determining, if it is determined that the time period until the estimated activation timing has become equal to the image quality adjustment period, whether or not a time period from preceding quality adjustment of a toner image for the inactive image forming unit until the estimated activation timing is equal to or shorter than a threshold; and not causing the quality of the toner image to be formed by the inactive image forming unit to be adjusted if it is determined that the time period from the preceding quality adjustment of a toner image for the inactive image forming unit until the estimated activation timing is equal to or shorter than the threshold, and, if it is determined that the time period from the preceding quality adjustment of a toner image for the inactive image forming unit until the estimated activation timing is longer than the threshold, causing the preliminary toner image to be transferred onto the transfer body and causing the quality of the toner image to be formed by the inactive image forming unit to be adjusted in accordance with the result of detection performed in the detecting, while a toner image is being formed by an active image forming unit among the plurality of image forming units before the grasped estimated activation timing arrives.

* * * * *